United States Patent [19]

Bergemann

[11] Patent Number: 4,993,326

[45] Date of Patent: Feb. 19, 1991

[54] RAIL SWITCH

[75] Inventor: Horst Bergemann, Landsberg, Fed. Rep. of Germany

[73] Assignee: Veit Transpo GmbH, Landsberg/Lech, Fed. Rep. of Germany

[21] Appl. No.: 360,180

[22] Filed: Jun. 1, 1989

[30] Foreign Application Priority Data

Jun. 3, 1988 [DE] Fed. Rep. of Germany ..... 3819009

[51] Int. Cl.[5] ..... E01B 25/22; E01B 25/26; E05D 11/00; B61B 13/06

[52] U.S. Cl. ..... 104/89; 104/103; 16/360

[58] Field of Search ..... 104/91, 130, 89, 93, 104/96, 103; 16/357, 360

[56] References Cited

U.S. PATENT DOCUMENTS

| | | | |
|---|---|---|---|
| 994,124 | 6/1911 | Colahan | 104/91 X |
| 1,296,989 | 3/1919 | McMeeken | 104/91 |
| 4,944,227 | 7/1990 | Madsen | 104/103 |

FOREIGN PATENT DOCUMENTS 1044711 9/1983 U.S.S.R. .

*Primary Examiner*—Robert P. Olszewski
*Assistant Examiner*—Alfred Muratori
*Attorney, Agent, or Firm*—Finnegan, Henderson, Farabow, Garrett & Dunner

[57] ABSTRACT

A rail switch (1), particularly for an overhead conveyor system, adapted to assume at least two switch positions (I, II, III) for selectively connecting a first rail (2) comprising a runway (2*a*, 2*b*) for casters (7*a*, 7*b*) of conveyor carriages (6) to the free ends of other rails (3, 4, 5). The switch includes a switch portion (10) carrying a corresponding runway (10*a*, 10*b*) and having one of its ends connected to the free end of the first rail (2) by a hinge (9) permitting it to be pivoted about a pivot axis (11) so that the opposite free end of the switch portion (10) may be selectively connected to the free ends of the other rails (3, 4, 5). To ensure substantially smooth passage of the casters (7*a*, 7*b*) over the hinge (9), the runway adjacent the hinge (9) is formed by mutually overlapping runway surface portions (17*a*, 17*b*, 19*a*, 19*b*) on the switch portion (10) and on the first rail (2).

17 Claims, 10 Drawing Sheets

RAIL SWITCH

BACKGROUND OF THE INVENTION

The present invention relates to a rail switch particularly for an overhead conveyor system adapted to assume at least two switch positions.

A switch of this type is known from GB Patent No. 1,094,319. In the known switch the switch portion is connected to the first rail by a universal joint having two pivot pins extending perpendicular to one another. One of the pivot pins permits the switch portion to be displaced to the various switch positions, while the second pivot pin permits the free end of the switch portion to be lifted for placing it onto the free end of the rail to which it is to be connected. The universal joint is surrounded by a helical spring provided on the one hand for aiding the required movements of the joint and on the other hand for acting as a running surface for the casters. The smallest possible pitch of the helical spring is limited by the mutual abutment of the spring windings on the inner side of the angle formed by the switch portion in its maximum angled position. As a result, the spring windings extend at mutual spacings on all sides in all other positions of the switch portion. The thus created gaps between the spring windings are additionally widened by the circular crosssection of the spring wire, so that the casters cannot roll smoothly over the joint.

It is therefore an object of the invention to improve a rail switch of the type defined above in such a manner that it provides a substantially smooth runway surface for said casters spanning the joint.

SUMMARY OF THE INVENTION

This object is attained according to the invention by providing a rail switch for connecting the free end of a first rail to the free ends of at least two other similarly shaped rails, each of said rails having a centerline and a runway formed of two angularly inclined runway surfaces on either side of the center line which are adapted to carry a pair of similarly angularly inclined casters of a conveyor carriage, the rail switch comprising a switch portion having a corresponding runway connected at one end to the free end of the first rail by a hinge means that permits the switch witch portion to pivot about an axis located on the centerline of the first rail for selective connection of its opposite end to the free ends of said other rails, at least a portion of the runway surfaces of the switch portion at said one end adjacent said hinge means overlapping a portion of the runway surfaces of the free end of the first rail and at least a part of the overlapped portion of the runway surfaces of the first rail being inclined inwardly at an angle $\alpha$ in a direction towards the centerline of the first rail.

The mutually overlapping runway portions provided according to the invention ensure that each caster contacts one of these runway portions at least with a part of its circumferential surface at the location of the joint. In this manner the casters are enabled to travel substantially smoothly over the gaps unavoidably opening between the switch portion and the first rail as the former is being pivoted.

BRIEF DESCRIPTION OF THE DRAWINGS

Embodiments of the invention shall now be described in detail by way of example with reference to the accompanying drawings, wherein:

FIG. 10 shows a sideview of the switch shown in FIG. 8, FIG. 11 shows a sideview of a part of a hinge, FIG. 12 shows a top plan view of the part shown in FIG. 11, FIG. 13 shows a sideview of a part of a hinge, and FIG. 14 shows a top plan view of the part shown in FIG. 13.

DETAILED DESCRIPTION OF THE INVENTION

Figure 1:
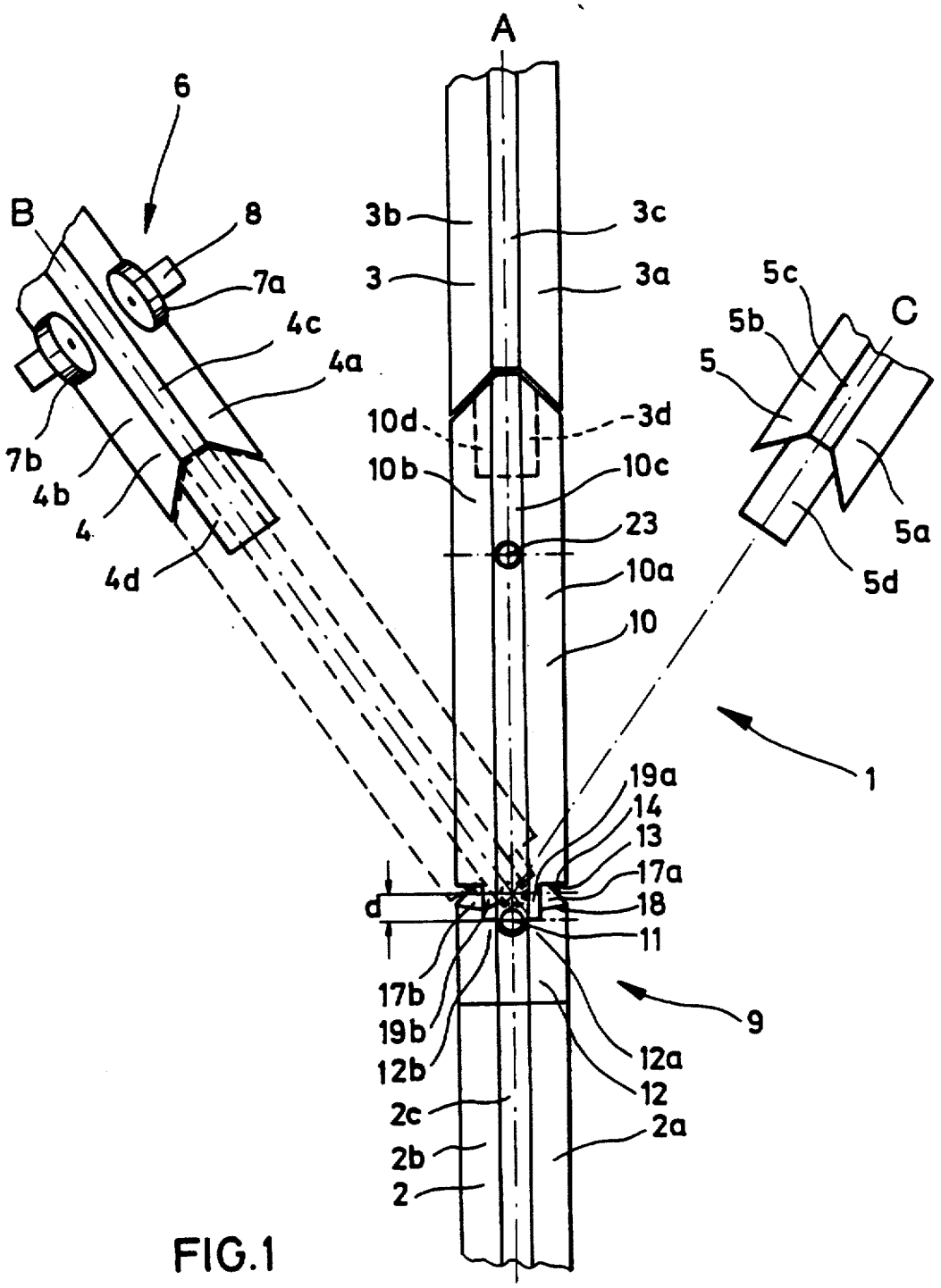
FIG. 1 shows a top plan view of a rail switch in a first embodiment of the invention.
Figure 2:
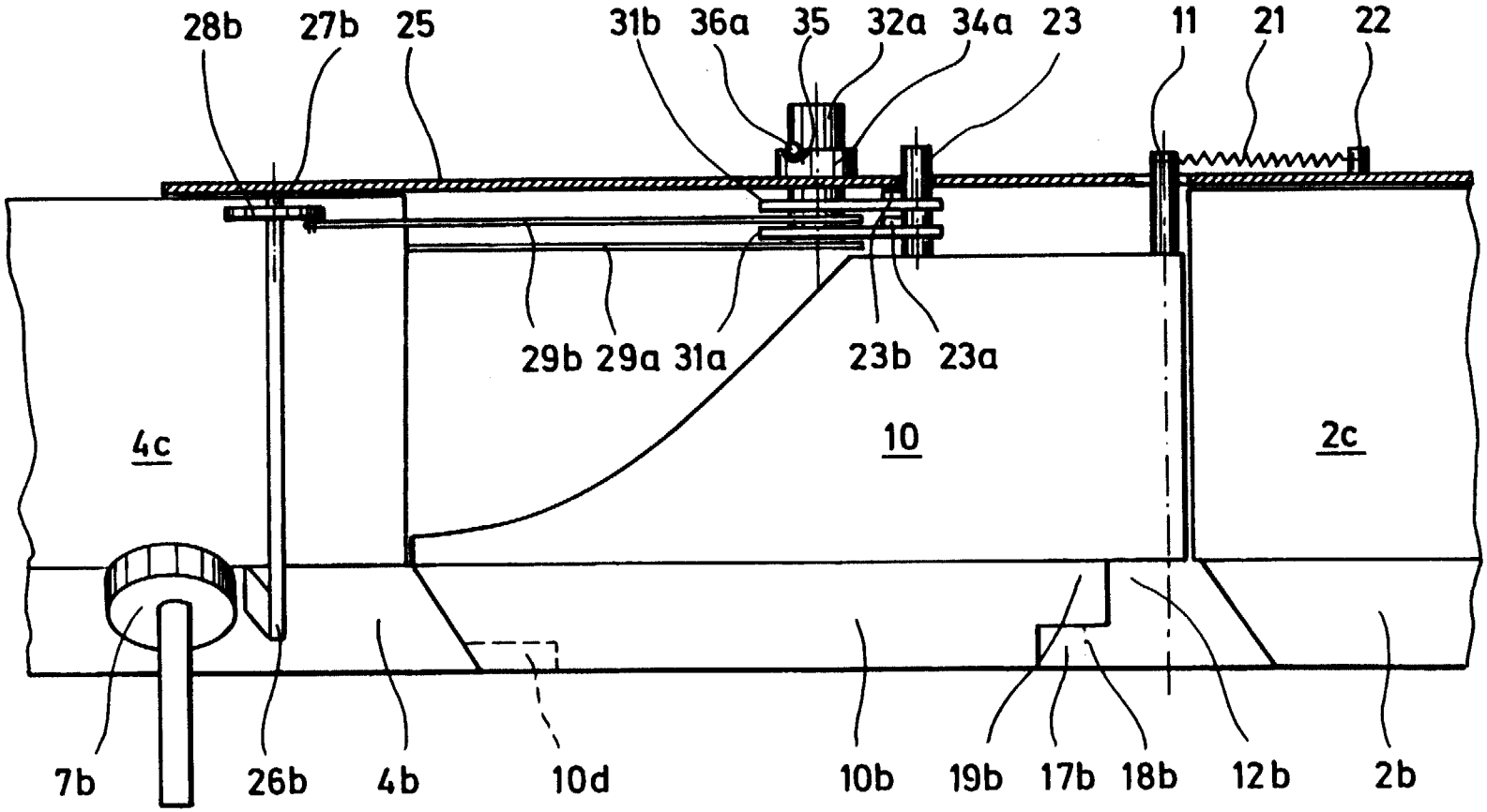
FIG. 2 shows a sideview of the switch of FIG. 1.

Shown in FIG. 1 is a top plan view of a first embodiment of a rail switch 1 for use as a deviation switch in an overhead conveyor system not shown in further detail. Extending towards switch 1 are a first rail 2 from a first direction, and other rails 3, 4 and 5 from other directions. Each rail 2, 3, 4, 5 is of substantially conventional construction, including a runway formed of two runway surfaces *2a, 2b; 3a, 3b; 4a, 4b; 5a, 5b* inclined relative to one another at an angle of preferably 90°. Also in the conventional manner, each rail is additionally formed with a central web portion *2c, 3c, 4c, 5c* by which it may be suspended. Rails 2 to 5 are designed for cooperation with conveyor carriages 6 having a pair of casters *7a, 7b* formed with cylindrical circumferential surfaces for engaging the respective runway surfaces of the rails and connected to one another by a stirrup hanger 8 extending around the lower part of the rails. Conveyor carriages 6 are designed to have articles to be conveyed and not shown in detail to be suspended therefrom in the conventional manner. The other rails 3 to 5 are mounted so that the centerline of rail 3 is aligned with the centerline of first rail 2, while the centerlines of rails 4 and 5 extend in the same horizontal plane so as to include an angle with the centerlines of rails 2 and 3. The free ends of rails 3 to 5 are chamfered forwards and downwards and provided with a respective support bracket *3d, 4d, 5d* acting as a wear member.

A pivot and translation hinge 9 connects the free end of first rail 2 to one end of a switch portion 10 preferably formed as a moulded member having substantially the same profile as rails 2 to 5, including a runway formed of two runway surfaces *10a* and *10b* extending at an angle relative to one another, and a central web *10c*. The free end of switch portion 10 opposite hinge 9 is chamfered rearwards and downwards to correspond to the shape of the free ends of rails 3 to 5, and includes a recess *10d* for receiving a respective support bracket *3d, 4d* or *5d* therein.

As also shown in FIGS. 2 to 5, pivot and translation hinge 9 has a pivot axis 11 formed by a pin extending through switch portion 10 and through a bearing member 12 secured to first rail 2. Pivot axis 11 is capable of displacement in the conveying direction by a distance d, so that in the switch position A, in which switch portion 10 interconnects the aligned rails 2 and 3, at least part of the rear end face 13 of switch portion 10 is in abutment with at least part of an end face 14 of bearing member 12. When switch portion 10 is pivoted from its position A to the position B shown in phantom lines for connecting first rail 2 to rail 4, pivot axis 11 is displaced in the conveying direction by the distance d, this distance d and the pivot angle between positions A and B being determined relative to one another so that also in position B, at least parts end faces 13 and 14 on one side of the centerlines of switch portion 13 and first rail 2, respectively, are in mutual abutment. The pivotal movement of switch portion 10 to position C for interconnecting rails 2 and 5 occurs in the same manner, although in the opposite direction.

The translation path, i.e. the distance d by which pivot axis 11 is displaced, is determined by the length of an elongate hole 15 in bearing member 12 shown in FIGS. 4 and 5, in which pivot axis 11 is freely slidable and, as will be explained as the description proceeds, tiltable.

Figure 4:
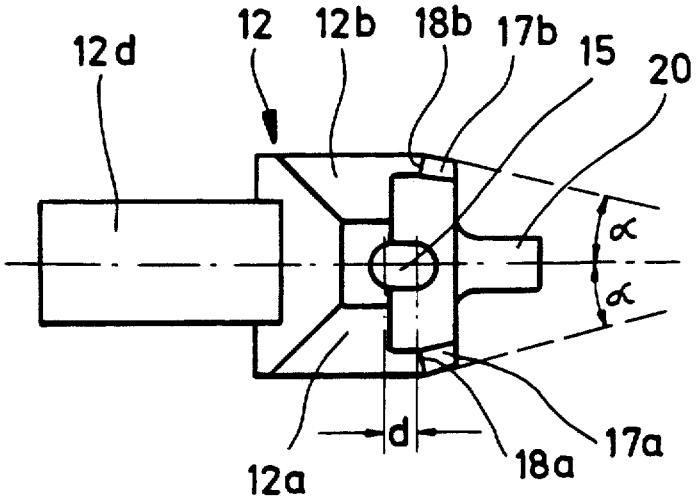
FIG. 4 shows a top plan view of a part of the hinge of the switch shown in FIG. 1.
Figure 5:
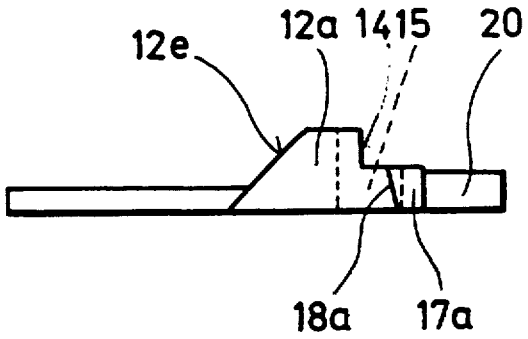
FIG. 5 shows a sideview of the part shown in FIG. 4.

As clearly shown in FIGS. 4 and 5, bearing member 12 also includes a runway formed of two runway surfaces **12*a*, 12*b* extending at an angle relative to one another similar for instance to runway surfaces 2*a* and 2*b* of first rail 2. Runway surfaces 12*a* and 12*b* are disposed in linear alignment with runway surfaces 2*a* and 2*b*, respectively, so that at least their portions adjacent runway surfaces 2*a* and 2*b* extend at a level permitting them to be contacted by the circumferential surfaces of casters 7*a* and 7*b*. In the direction towards switch portion 10, runway surfaces 12*a* and 12*b* are extended by respective runway surface portions 17*a*, 17*b* supported by a bar below a recess defined by end face 14 and extending substantially over the lower half of the surface area contacted by casters 7*a* and 7*b*, respectively. The forward portions of these lower runway surface portions 17*a* and 17*b* are inclined towards the centerline by an angle $\alpha$, a transition being formed by a respective edge 18*a*, 18*b*. Angle $\alpha$ substantially corresponds to the pivot angle of switch portion 10** between position A and a respective one of positions B and C.

Figure 3:
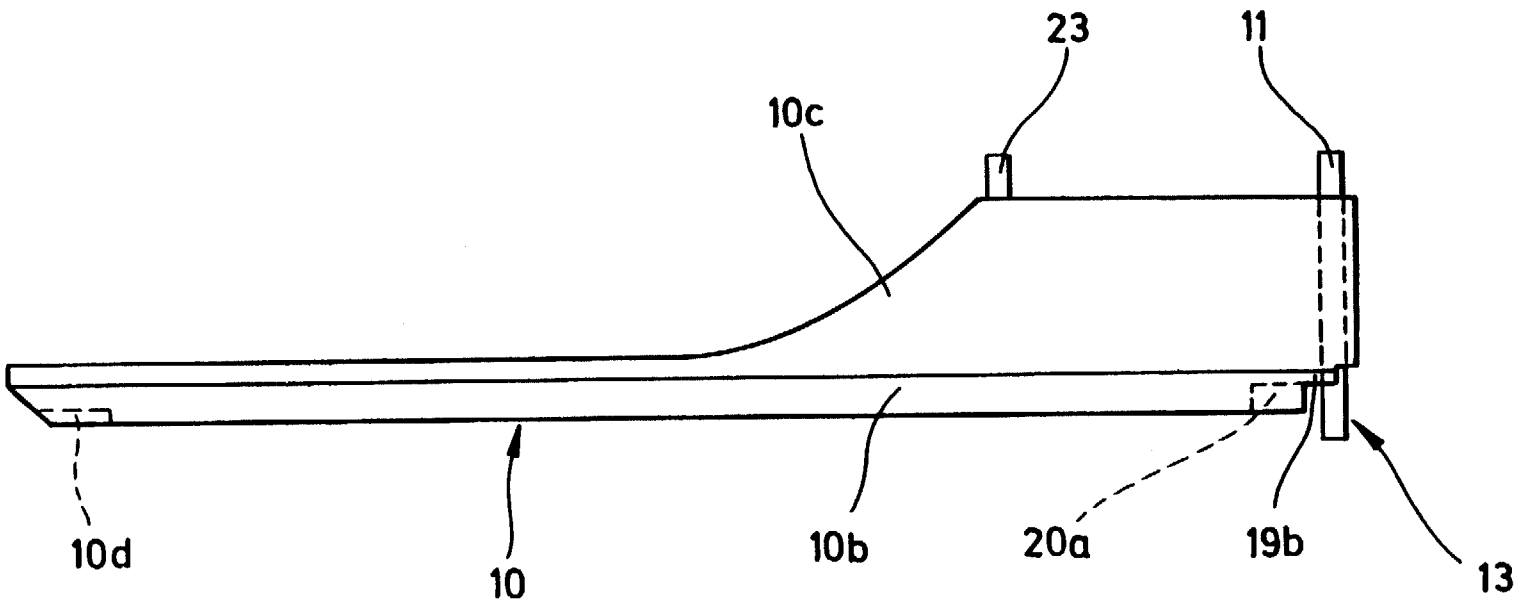
FIG. 3 shows a sideview of a switch portion of FIG. 1.

As shown in FIGS. 1 and 3, the runway of switch portion 10 is extended towards bearing member 12 by runway surface portions **19*a*, 19*b* extending parallel to the centerline of switch portion 10 in linear alignment with runway surfaces 10*a* and 10*b*, respectively. These runway surface portions 19*a* and 19*b* extend substantially over the upper half of the surface area contacted by casters 7*a* and 7*b*, respectively, and above a recess into which the lower runway surface portions 17*a* and 17*b* of bearing member 12** extend.

When switch portion 10 is in its position A shown in FIG. 1, runway surfaces **12*a* and 12*b* of bearing member 12 extend in linear alignment with the extended runway surface portions 19*a* and 19*b* and runway surfaces 10*a*, 10*b*, respectively, of switch portion 10. This permits casters 7*a*, 7*b* to travel substantially smoothly from runway surfaces 12*a*, , 12*b* onto runway surface portions 19*a*, 19*b*, and from there onto runway surfaces 10*a*, , 10*b*, since it is only the lower part of the circumferential surfaces of casters 7*a* and 7*b* which has to travel over the gap formed by the inclined runway surface portions 17*a* and 17*b*, while the upper half of the circumferential surfaces of casters 7*a* and 7*b* travels smoothly over runway surface portions 19*a* and 19*b***.

When switch portion 10 is switched to its position B shown in phantom lines in FIG. 1, a part of end face 13 on one side of the centerline comes into abutment with the inclined runway surface portion **17*b*, so that the acute transition angle is rendered less acute. Although this results in the opening of a respective gap on the other side of the centerlines between the extended runway surface portion 19*a* and the portion of runway surface 12*a* extending at the same level, and between the lower runway surface portion 17*a* and the lower portion of runway surface 10*a*, these gaps can be readily passed by caster 7*b*, as will be explained. Thanks to the selected angle of inclination, runway surface portion 17*a* already extends in the direction now assumed by runway surface portion 19*a* and runway surface 10*a* of switch portion 10. In this position, the extended runway surface portion 19*a* is located immediately above the end of runway surface portion 17*a*. The caster 7*a* approaching runway surface 12*a* passes onto runway surface portion 17*a* with its lower part, and is already deflected to the new direction after passing transition edge 18. During its passage from first rail 2 over hinge 9 and onto switch portion 10 aligned in its position B, caster 7*a* initially travels on runway surfaces 2*a* and 12*a*, respectively, with the full width of its circumferential surface, whereupon the lower half of its circumferential surface comes into contact with runway surface portion 17*a*, while the upper half of the circumferential surface passes over the gap formed by the switching of switch portion 10. Shortly after passing transition edge 18*a*, the upper half of the circumferential surface of caster 7*a* comes into contact with runway surface portion 19*a* of switch portion 10, permitting caster 7*a* to travel smoothly over the further gap fomed between runway surface portion 17*a* and switch portion 10**. The same sequence of movements occurs in the reverse sense in position C.

Thus this arrangement facilitates the passage of a caster over the joint, particularly in the case of a runway consisting of two runway surfaces extending at angular orientation relative to one another. The angularly oriented runway surface portion is effective to guide the caster in the direction of the switch portion in its pivoted position before the caster passes onto the runway surface portion of the switch portion. This construction ensures that the inavoidably opening gap is not formed at the very location where the respective caster has to change its direction of travel. Although this construction results in a wedge-shaped gap being created between the switch portion and the first rail in the linearly aligned position, this gap is overlapped by the runway surface portion of the switch portion, permitting smooth passage thereover of the caster.

By way of completion it shall be pointed out that bearing member 12 is fixedly connected to rail 2 by *a* bracket **12*d* similar to support brackets 3*d*, 4*d* and 5*d*, and formed with a chamfer 12*e* complementary to that of rail 2, so that the free ends of all rails 2 to 5** may be of identical shape.

In addition, bearing member 12 is provided with a stabilizing extension 20 received in an enlarged recess **20*a* in the bottom side of switch portion 10**.

Figure 7:
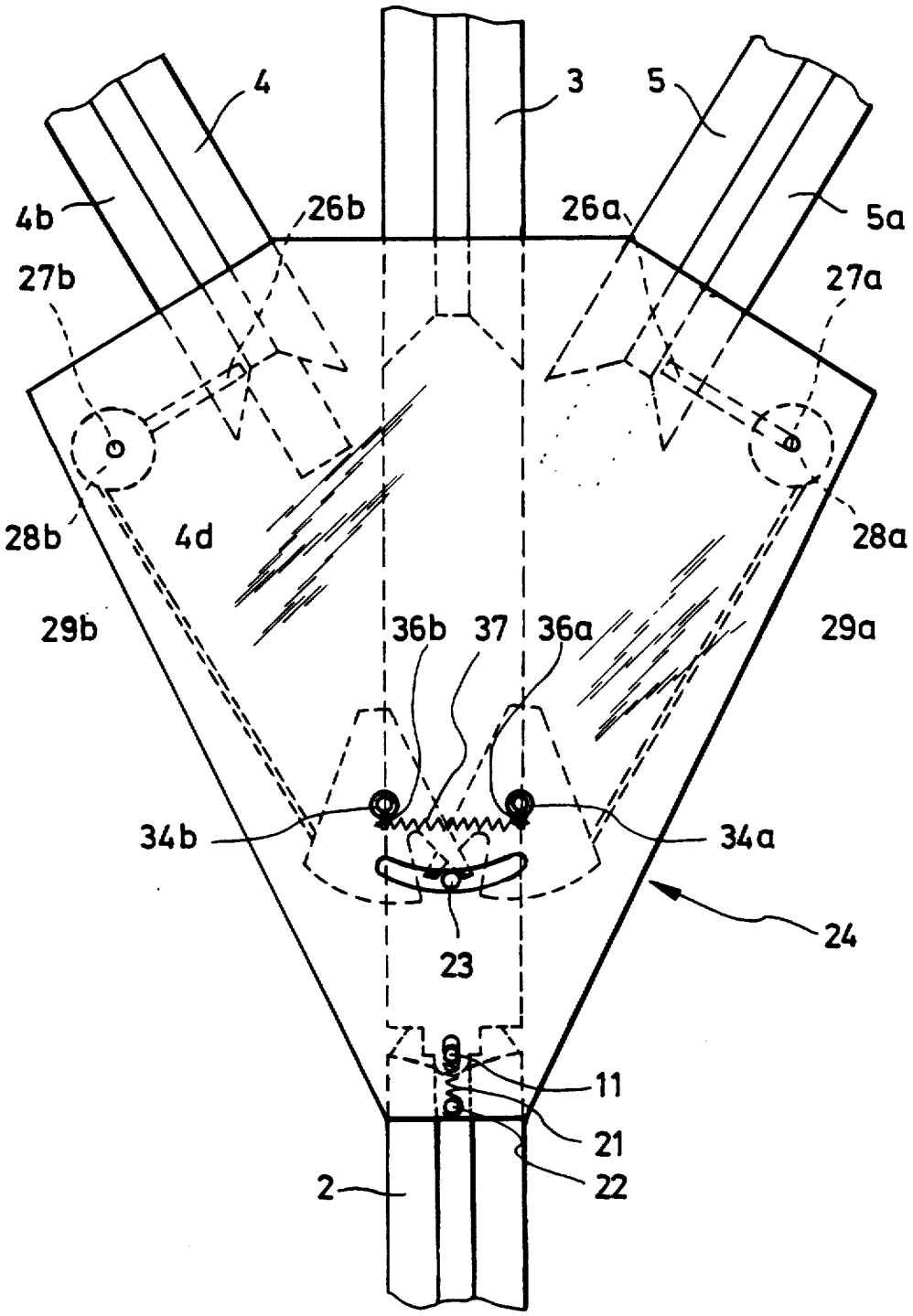
FIG. 7 shows a top plan view of the switching mechanism.

As shown in FIGS. 3 and 7, pivot axis 11 is extended to project upwards from switch portion 10. This upper extension is engaged by a spring 21, the other end of which is secured to a pin 22 disposed at a fixed position relative to pivot axis 11, for instance on first rail 2. Spring 21 is tensioned when pivot axis 11 extends vertical and is completely retracted towards rail 2 in elongate hole 15. Pivot axis 11 is non-tiltably connected to switch portion 10. As a result, spring 21 tends to tilt pivot axis 11, and thus switch portion 10, about a tilt center located in elongate hole 15 or therebelow. The spring force of spring 21 is smaller, however, than the weight of switch portion 10 and its lever action, so that this tilting action cannot take place automatically, the spring being only effective to reduce the force required for tilting the switch portion. The switch portion 10 can thus be tilted by lifting its free end with a small force. This permits the engagement between recess 10*d* and the respective support bracket 3*d*, 4*d* or 5*d* to be released and switch portion 10 to be subsequently pivoted in a horizontal direction. The alignment of pin 22 and pivot axis 11 in the conveying direction results in spring 21 being extended by the displacement of pivot axis 11 by the distance d in response to switch portion 10 being pivoted to position B or C. As a result, spring 21 tends to pivot switch portion 10 back to position I. In the present example, position A thus defines a normal switch position to which switch portion 10 tends to return in the absence of a switching force acting thereon.

Figure 6:
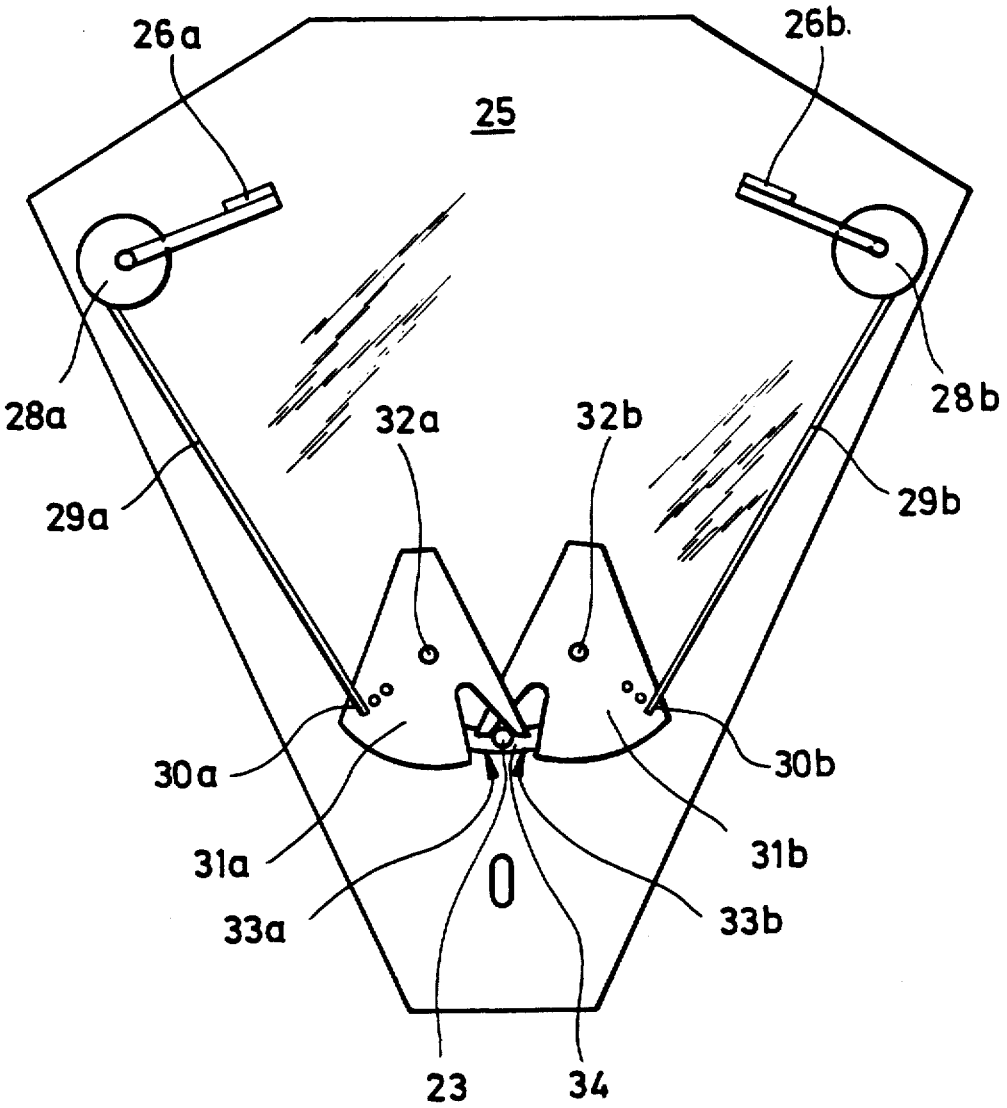
FIG. 6 shows an illustration of the switching mechanism of the switch shown in FIG. 1.

As shown in FIG. 3, switch portion 10 additionally carries a switching cam member 23 belonging to a switching mechanism 24 for automatically pivoting switch portion 10 to position B or C by an approaching conveyor carriage 6. Switching mechanism 24 is mounted on a base plate 25 (not shown in FIG. 1) extending above switch 1. As shown in FIGS. 6 and 7, switching mechanism 24 comprises a pair of identical stop members 26*a*, 26*b* mounted in a mirrorimage configuration. Stop members 26*a* and 26*b* project into the paths, respectively, of casters approaching on runway surface 5*a* of rail 5 or runway surface 4*b* of rail 4. Both stop members 26*a*, 26*b* are mounted on base plate 25 for pivoting about respective pivot axes 27*a* and 27*b*. Fixedly connected to each pivot axis 27*a*, 27*b* is a respective crank disc 28*a*, 28*b* having a connecting rod 29*a*, 29*b* articulated thereto. Each connecting rod 29 has its opposite end connected at 30*a* or 30*b*, respectively, to a respective plate-shaped cam guide 31*a*, 31*b*. Cam guides 31 are of identical shape and mounted in mirror-image configuration. Each cam guide is mounted on base plate 25 for pivoting about a respective pivot axis 32*a*, 32*b* spaced from the respective connection point 30*a*, 30*b*. At a spaced location from pivot axis 32, each cam guide 31 is formed with a fork-shaped groove 33*a*, the two grooves 33 intersecting one another and cooperating to retain cam member 23 therein, the latter extending through and being guided in a transverse slot 34 formed in base plate 25. Each pivot axis 32 is vertically displaceable and extends through base plate 25 and a respective bushing 34*a*, 34*b*. Each bushing 34 is formed with upwards opening detent seats 35, bushing 34*a* being provided with at least two detent seats defining positions A and C, and bushing 34*b* having at least two detent seats corresponding to positions A and B. Detent seats 35 are adapted to be engaged by a respective detent pin 36*a* or 36*b* fixedly connected to the respective pivot axis 32. Detent pins 36*a* and 36*b* are interconnected by a tension spring 37. Rotation of one of the cam guides 31 and thus of the associated pivot axis 32 results in the respective detent pin 36 leaving detent seat 35 to thereby lift the respective pivot axis 32 with its cam guide 31. Switching cam member 23 is provided with projections 23*a*, 23*b* overlying the respective cam guide 31, projections 23*a*, 23*b* being engaged with the associated cam guide 31*a* or 31*b*, respectively, when detent pins 36 are seated in one of detent seats 35 and pivot axis 11 is in vertical alignment. A displacement of detent pins 36 out of detent seats 35 with the resultant lifting of the associated pivot axis 32 and cam guide 31 results in one of the two projections being entrained, while the other projection 23 is released from its engagement, in response to which the free end of switch portion 10 is lifted and pivot axis 11 is correspondingly tilted.

This construction thus permits the switch portion to be locked in each switch position by a vertically acting detent effect. Further, the tiltable mounting of the pivot axis defining the joint permits the tilting angle and the tilting direction to be accurately determined, thus eliminating the need for additional devices to limit the movement of the switch portion.

Cam guides 31 are in their symmetrical positions shown in FIGS. 6 and 7 when switch portion 10 is at its position A, the tension of spring 37 being smallest in this position. With switch portion 10 in its position A, when a conveyor carriage 6 approaches switch 1 on rail 4, its caster 7*b* comes into engagement with stop member 26*b* to displace it in the direction of travel, resulting in clockwise rotation of crank disc 28*b*. The resulting tractive force acting on connecting rod 29*b* is transmitted to cam guide 31*b*, tending to rotate it about pivot axis 32*b*. The pivot angle of cam guides 31 may be varied by selecting any one of several articulation points 30 of which three are shown in the drawings. The clockwise rotation of cam guide 31*b* results in pivot axis 32*b* being lifted, as a result of which switch portion 10 is tilted upwards to release the engagement between its recess 10*d* and support bracket 3*d*. Further rotation cf cam guide 31*b* results in switching cam member 23 being displaced to the left, so that switch portion 10 is pivoted to its position B. In this position pins 36 again drop into an associated detent seat 35, as a result of which switch portion 10 is lowered by the action of its own weight and of the force applied thereto by the weight of the conveyor carriage approaching at a determined speed, so that support bracket 4*d* is received in recess 10*d*. The weight of the conveyor carriage 6 then acts to retain switch portion 10 in the desired position, even when stop member 26*b* is no longer engaged by the respective caster.

This construction ensures that the switch is always connected to the rail on which a conveyor carriage is approaching the switch, so that even faulty operation cannot result in a conveyor carriage dropping off the rails at the location of the switch.

During this rotation the other cam guide 31*a* has scarcely moved, resulting in spring 37 being tensioned. After the conveyor carriage 6 has subsequently passed over switch portion 10 and hinge 9 and onto rail 2, switch portion 10 is again tilted upwards by the cooperation of springs 21 and 27 and returned to its position A, as a result of which the cam guides and stop member 26*b* likewise return to their original positions.

During the rotation of switch portion 10 to its position A, switching cam member 23 is also in full engagement with the fork-shaped groove 33*a* of the other cam guide 31*a* to thereby prevent the latter from being rotated. This is effective to also prevent crank disc 28*a* from being rotated, so that stop member 26*a* is locked and cannot be displaced by a conveyor carriage approaching the switch on rail 5.

A locking mechanism of similar construction, which may for instance be operable by the cam guides via a bowden cable, may if need be also be provided for position A.

Figure 8:
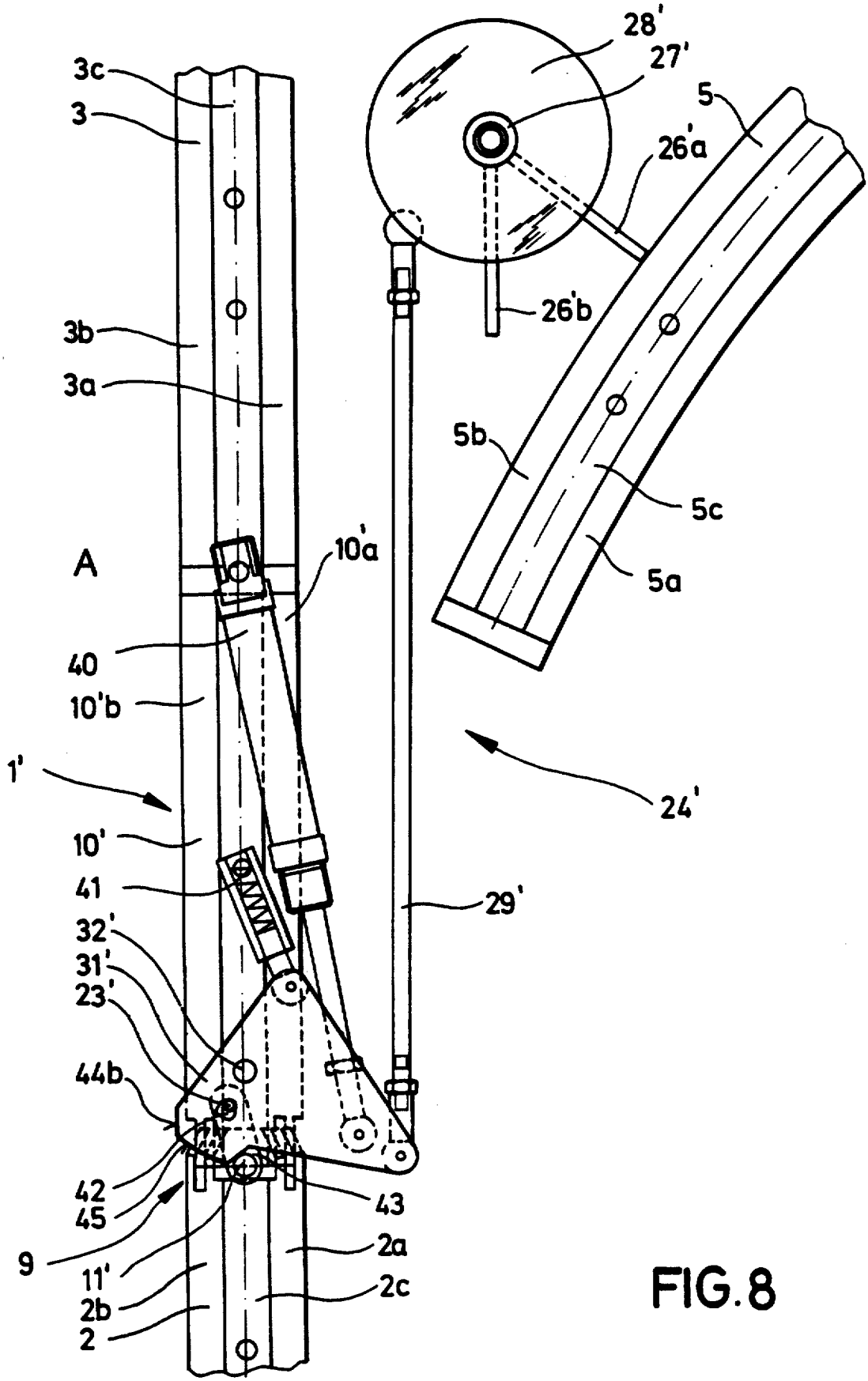
FIG. 8 shows a top plan view of a rail switch according to a further embodiment of the invention.
Figure 9:
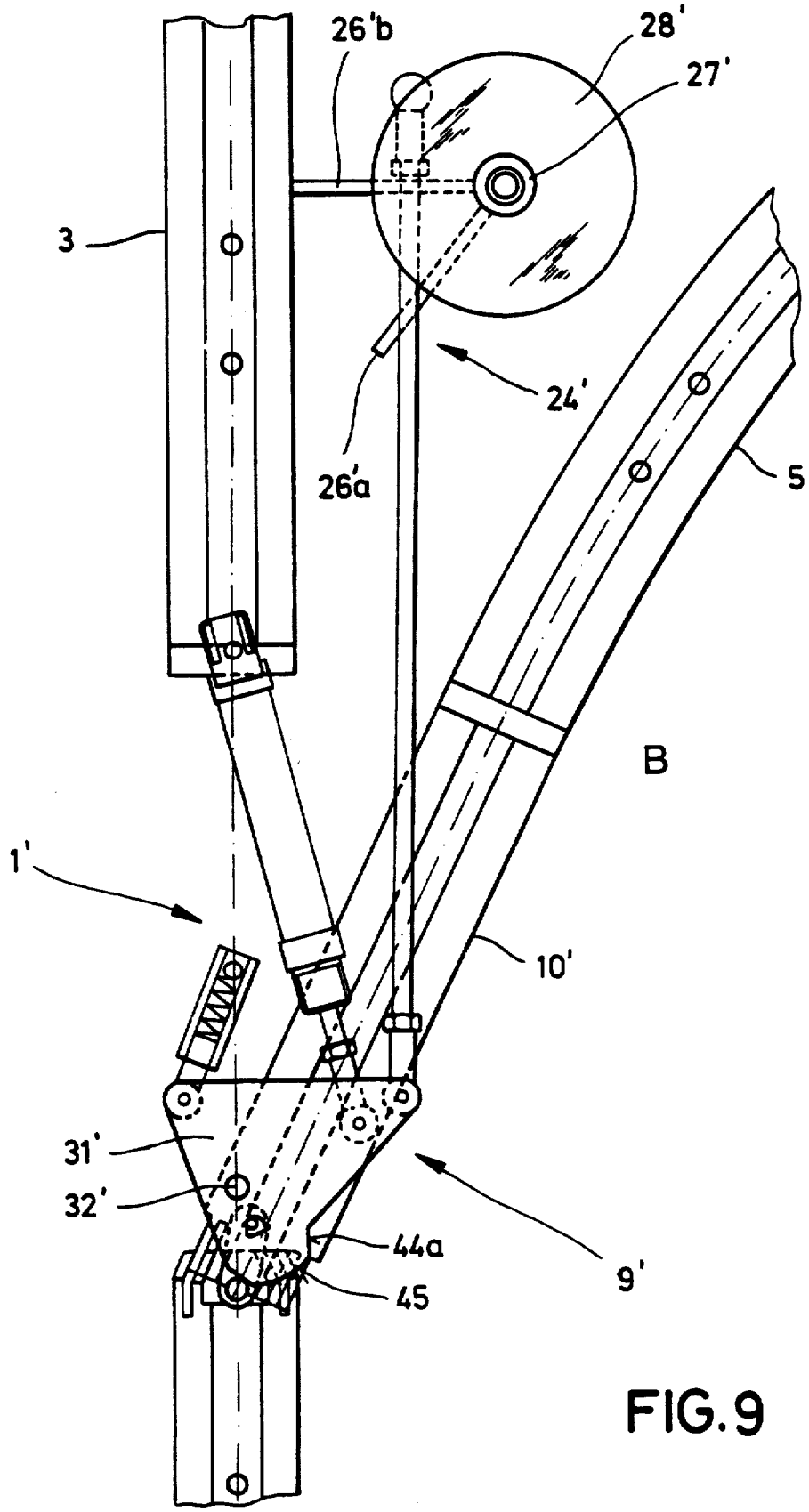
FIG. 9 shows a top plan view of the switch shown in FIG. 8 in a second position thereof.

FIGS. 8 and 9 show top plan views of another embodiment of a rail switch 1', wherein identical or similar components are designated by the same reference numerals as above and need not be described again.

Rail switch 1' again comprises a first rail 2', two other rails 3 and 5, and a switch portion 10' pivotally connected to first rail 2' by a hinge 9'. All rails 2, 3, 5 as well as switch portion 10' have respective runways each formed by two angularly inclined runway surfaces 2a, 2b; 3a, 3b; 5a, 5b; 10'a, 10'b for the angularly inclined casters of a conveyor carriage (not shown) corresponding to that of the first embodiment. Rails 2, 3 and 5 are also formed with the already described central web 2c, 3c and 5c.

In this embodiment switch portion 10' is only pivotable between positions A (FIG. 8) and B (FIG. 9). The switch is provided with a single plate-shaped cam guide 31' having a vertical pivot axis 32' mounted at a fixed position in a base plate 25 not shown in FIGS. 8 and 9. At a spaced location from pivot axis 32', cam guide 31' is engaged by an operating piston 40 operable to rotate cam guide 31'. Also connected to cam guide 31' is a spring 41, which is substantially relaxed when switch portion 10 is in either of its positions A and C, and which is tensioned when switch portion 10 is switched between the two positions.

Articulated to cam guide 31' at a spaced location from pivot axis 32' is a connecting rod 29' of a switching mechanism 24'. As already described, connecting rod 29' is articulated to the periphery of a crank disc 28' having a pivot axis 27' at its center for rotatably mounting it on base plate 25. Two stop members 26'a and 26'b are fixedly connected to pivot axis 27' so as to follow the rotation of crank disc 28'. Connecting rod 29' and stop members 26' are arranged in such a manner that stop member 26'a is disposed in the path of a conveyor carriage approaching along rail 5 when switch portion 10 is in its position A so as to interconnect rails 2 and 3. When operating piston 40 is operated to pivot cam guide 31 to the position C as shown in FIG. 9, in which switch portion 10' assumes its position C, stop members 26'a and 26'b are rotated in such a manner that stop member 26'b now projects into the path of a conveyor carriage approaching along rail 3, whereas stop member 26'a is no longer blocking the path along rail 5. The respective other rail 3 or 5 not connected to switch portion 10 is thus effectively blocked.

Cam guide 31' is further provided with an opening 42 for receiving therein a pin acting as a switching cam 23'. The dimensions of switching cam 23' are smaller than those of opening 42. Fixedly connected to switching cam 23' is a crank lever 43, the other end of which is fixedly connected to a pin acting as the pivot axis 11' of hinge 9'. Between opening 42 and pivot axis 11' the periphery of cam guide 31 is formed with two detent surfaces 44a (FIG. 9) and 44b (FIG. 8). Detent surfaces 44a and 44b are formed as inclined surfaces at steadily increasing distances from pivot axis 32'. The end portions of detent surfaces 44a and 44b facing away from pivot axis 32' are interconnected by a bearing surface 45. Pivot axis 32' of cam guide 31'and pivot axis 11' of hinge 9' are located on a common centerline forming an extension of the centerline of first rail 2.

As also shown in FIG. 10, pivot axis 11' of hinge 9' is fixedly connected to switch portion 10' as already described. At the location of hinge 9', pivot axis 11' extends through an opening 46 having a forwards and downwards directed extension 46a permitting pivot axis 11' to be tilted towards first rail 2 by an angle $\beta$ (FIG. 11) to thereby lift the free end of switch portion 10'. Base plate 25 is formed with a corresponding elongate hole 47 for pivot axis 11' to extend therethrough. As shown in FIGS. 8 and 9, the distance between pivot axis 32' of cam guide 31' and pivot axis 11' of hinge 9' is determined so that pivot axis 11' assumes a vertical position when engaging detent surfaces 44a, 44b. On the other hand, the distance between bearing surface 45 and pivot axis 32' is greater than the distance between pivot axis 32' and pivot axis 11' in the vertical position of the latter. Operation of operating piston 40 for rotating cam guide 31' in such a manner that bearing surface 45 comes into engagement with pivot axis 11' thus results in the latter being tilted rearwards, i.e. in the direction towards first rail 2, in response to which the free end of switch portion 10' is lifted.

The components of hinge 9' are more clearly illustrated in FIGS. 11 to 14. FIGS. 11 and 12 show a side-view and a top plan view, respectively, a forward extension 48 of first rail 2. Forward extension 48 is slotted in a direction perpendicular to pivot axis 11', so that each runway surface 2a, 2b of first rail 2 is extended by two runway surface portions 48a, 48c and 48b, 48d, respectively. Between runway surface portions 48a and 48c and 48b and 48d, respectively, and above runway surface portions 48c and 48d, respectively, extension 48 is formed with recesses limited by a respective end face 14'. In the manner already described, the forward section of all runway surface portions 48a to 48d is inclined by an angle $\alpha$ towards the centerline, with the formation of a respective transition edge 18a, 18b extending over all of the runway surface portions.

FIGS. 13 and 14 show the end portion of switch portion 10' adjacent hinge 9'. In a manner similar to extension 48 of first rail 2, switch portion 10' is slotted in a direction perpendicular to pivot axis 11', so that the runway surfaces 10'a and 10'b of switch portion 10' are divided into two runway surface extensions 19'a, 19'c and 19'b and 19'd, respectively. Between runway surface extensions 19'a and 19'c and 19'b and 19'd, respectively, and below runway surface extensions 19'a and 19'b, respectively, switch portion 10' is again formed with recesses permitting each of the respective runway surface extensions to be received in the recesses formed in the opposite member so that runway surface portions 48a to 48d and runway surface extensions 19a to 19d, respectively, overlap one another in the conveying direction. In a direction parallel to pivot axis 11', the recesses are of greater width than the respective runway surface portions to thereby permit switch portion 10' to be tilted by the angle$\beta$. In the assembled state of hinge 9', moreover, the runway surface portions and extensions, respectively, do not extend to the end faces of the respective recesses, so that a distance remains between all parts of end face 13' of switch portion 10' and end face 14' of extension 48. This permits switch portion 10' to be readily pivoted relative to extension 48 at least between positions A and C. Although in this embodiment the gap formed in the conveying direction between extension 48 and switch portion 10' is of greater length than in the embodiment described in the first place, this gap can be readily passed by a caster of a conveyor carriage. In this embodiment, the circumferential surface of the caster is always in contact with two runway surface portions located above and below a gap, respectively, so that the caster is supported at two locations of its circumferential surface.

The described and illustrated embodiments may be varied by exchanging certain details amongst one another. It is thus for instance possible to provide an operating piston for the actuation of the embodiment of FIGS. 1 to 7, and to use the stop members provided in this embodiment only for blocking the respective rails. In the embodiment according to FIGS. 8 to 14, on the other hand, the operating piston may also be eliminated for the manual operation of the switch in a similar manner as in the embodiment of FIGS. 1 to 7, in which case the stop members may be used for automatically operating the switch when the conveying direction is reversed. The hinge shown in FIGS. 8 to 14 may also be employed in the embodiment according to FIGS. 1 to 7. The number and arrangement of the runway surface portions may also be varied. Different stop members and linkages may be employed for the switching mechanism. The cam guides may also be composed of a suitable lever mechanism rather than being formed as plate members. In all of the embodiments, the number of other rails may be varied as required.

I claim:

1. A rail switch for connecting a free end of a first rail to free ends of at least two other similarly shaped rails, each of said rails having a centerline and a runway formed of two angularly inclined runway surfaces on either side of the centerline which are adapted to carry a pair of similarly angularly inclined casters of a conveyor carriage, said rail switch comprising a switch portion having a corresponding runway connected at one end to the free end of said first rail by a hinge means that permits said switch portion to pivot about an axis located on the centerline of aid first rail for selective connection of an end opposite said one end to the free ends of said other rails, at least a portion of the runway surfaces of the switch portion at said one end adjacent said hinge means overlapping a portion of the runway surfaces of the free end of said first rail and at least a part of said overlapped portion of the runway surfaces of the first rail being inclined inwardly at an angle $\alpha$ in a direction towards the centerline of said first rail.

2. The switch of claim 1, wherein the portion of the runway surfaces of the switch portion that overlap a portion of the runway surfaces of the free end of said first rail extend into a corresponding recess formed in the end of said first rail.

3. The switch of claim 2 wherein said angle $\alpha$ corresponds to a maximum pivot angle of said switch portion.

4. The switch of claim 1, wherein said hinge means comprises a pin acting as said pivot axis and mounted in an opening that permits said switch operation to be tiltable vertically by lifting its free end.

5. The switch of claim 4, wherein the pin is fixedly mounted in said switch portion and the opening is located in the free end of said first rail.

6. The switch of claim 5, wherein the opening is elongated in the direction of the centerline of the first rail so that the pin can pivot and translate in said opening in addition to being tiltable vertically.

7. The switch of claim 4, including a switch mechanism for automatically pivoting said switch portion to the rail upon which the casters of a conveyor carriage are approaching said switch, said mechanism including a stop member located in a path of said approaching casters for controlling operation of said mechanism and adapted to be pivoted into and out of the path of said casters on said rail.

8. The switch of claim 7, wherein said mechanism comprises a pivotably mounted cam guide operatively connected to said stop member and a cam mounted on said switch portion cooperating with said cam guide, whereby rotation of the guide by activation of the stop member pivots said switch portion to the free end of the rail upon which the casters are approaching the switch.

9. The switch of claim 8, wherein said cam guide includes a number of detent means corresponding to various positions of said switch portion for releasably holding the switch in position.

10. The switch of claim 9, including a separate stop member and a separate cam guide for each of said other rails in which the centerline of the rail extends at an angle to the centerline of said first rail.

11. The switch of claim 10, including at least 3 other rails, one being located in line with said first rail and the other 2 at an angle to and on either side of the centerline of said first rail wherein said cam guides are connected to a spring adapted to be tensioned in response to the rotation of a cam guide and the pivoting of said switch portion to either angularly extending rail.

12. The switch claim 10, wherein each cam guide includes a fork-shaped groove for receiving said cam on said switch portion.

13. The switch of claim 10, wherein each cam guide is mounted for vertical displacement, and each detent means includes a detent member adapted to engage a detent seat in the vertical direction.

14. The switch of claim 7, wherein said switch mechanism includes locking means for preventing the stop member on all other rails from operating said mechanism when the stop member on one of said rails has operated said mechanism until the casters have passed the switch portion.

15. The switch of claim 5, including spring means acting to aid in the tilting of the switch portion, a spring force of said spring being smaller than the weight of said switch portion and a force required for tilting it.

16. The switch of claim 7, including a number of detent means corresponding to the various positions of said switch portion for releasably holding the switch in position, said detent means comprising detent surfaces on said cam guide that cooperate with said pin.

17. The switch claim 16, wherein between said detent surfaces on said cam guide there is a bearing surface adapted to engage said pivot pin for tilting said switch portion.

* * * * *